US006997179B1

(12) United States Patent
Niemann

(10) Patent No.: US 6,997,179 B1
(45) Date of Patent: Feb. 14, 2006

(54) PROTECTIVE HOOD

(75) Inventor: Bradley Q. Niemann, Hillsboro, IL (US)

(73) Assignee: Essex PB&R Corporation, St. Louis, MO (US)

( * ) Notice: Subject to any disclaimer, the term of this patent is extended or adjusted under 35 U.S.C. 154(b) by 73 days.

(21) Appl. No.: 10/707,791

(22) Filed: Jan. 13, 2004

(51) Int. Cl.
*A62B 23/02* (2006.01)

(52) U.S. Cl. ..... 128/201.25; 128/206.12; 128/205.27; 128/201.23

(58) Field of Classification Search ..... 128/201.22, 128/201.23, 201.25, 201.29, 205.27, 205.29, 128/206.12
See application file for complete search history.

(56) References Cited

U.S. PATENT DOCUMENTS

| | | | | | |
|---|---|---|---|---|---|
| 3,789,839 | A | * | 2/1974 | Lund et al. | 128/201.25 |
| 4,627,431 | A | * | 12/1986 | Werjefelt | 128/201.25 |
| 4,643,182 | A | | 2/1987 | Klein | |
| 4,683,880 | A | * | 8/1987 | Werjefelt | 128/201.28 |
| 4,883,052 | A | | 11/1989 | Weiss et al. | |
| 5,040,530 | A | * | 8/1991 | Bauer et al. | 128/206.12 |
| 5,056,512 | A | * | 10/1991 | Bower et al. | 128/201.25 |
| 5,075,174 | A | | 12/1991 | Pyle | |
| 5,113,854 | A | * | 5/1992 | Dosch et al. | 128/201.23 |
| 5,139,813 | A | | 8/1992 | Yira et al. | |
| 5,165,394 | A | * | 11/1992 | Hochberg | 128/201.25 |
| 5,226,409 | A | * | 7/1993 | Bower et al. | 128/201.23 |
| 5,424,097 | A | | 6/1995 | Olson et al. | |
| 5,654,054 | A | | 8/1997 | Tropsha et al. | |
| 5,660,173 | A | | 8/1997 | Newton | |
| 5,680,653 | A | * | 10/1997 | Mathis et al. | 2/123 |
| 5,697,106 | A | * | 12/1997 | Baker et al. | 2/239 |
| 5,705,251 | A | * | 1/1998 | Morman et al. | 428/114 |
| 5,752,938 | A | * | 5/1998 | Flatland et al. | 604/167.01 |
| 5,875,775 | A | | 3/1999 | Nur et al. | |
| 5,957,131 | A | | 9/1999 | Hutchinson et al. | |
| 6,129,360 | A | | 10/2000 | Walker et al. | |
| 6,158,429 | A | | 12/2000 | Gardner et al. | |
| 6,233,748 | B1 | | 5/2001 | Gieger et al. | |
| 6,270,872 | B1 | | 8/2001 | Cline et al. | |
| 6,340,024 | B1 | * | 1/2002 | Brookman et al. | 128/201.25 |
| 6,586,048 | B1 | | 7/2003 | Welch, Jr. et al. | |
| 2002/0168530 | A1 | | 11/2002 | Tingey et al. | |
| 2002/0182392 | A1 | | 12/2002 | Welch, Jr. et al. | |
| 2003/0066972 | A1 | | 4/2003 | Leblans et al. | |
| 2003/0111074 | A1 | | 6/2003 | Alon et al. | |

* cited by examiner

*Primary Examiner*—Mital Patel
(74) *Attorney, Agent, or Firm*—Blackwell Sanders Peper Martin LLP

(57) ABSTRACT

A neck seal for use in an emergency breathing apparatus has an interior and an exterior and is formed of an annular sheet of elastomeric material having a substantially central aperture for donning over a person's head. The substantially central aperture is sized appropriately for snug fitting around the person's neck so as to be sufficiently tight to prevent passage between the person's neck and the neck seal of fluid materials without choking the person. The neck seal is coated at least in part with parylene, to thereby prevent passage through the elastomeric material of NBC/CBR materials.

15 Claims, 4 Drawing Sheets

PROTECTIVE HOOD

BACKGROUND OF INVENTION

The present invention relates, generally, to breathing apparatuses, such as hoods of the type to protect the wearer's head and respiratory system during escape from smoke or dangerous fumes, and, more particularly, to such a hood which is provided with a silicone neck "dam" or seal having a coating of parylene to thereby reduce permeability of the neck dam by nuclear, biological, chemical/chemical, biological, radiological ("NBC/CBR") warfare agents.

SUMMARY OF INVENTION

Neck dams or collars of known protective breathing devices (hoods) are sometimes formed of silicone rubber molded into a thin membrane. Silicone rubber is a favorable elastomer for this use due to its physical properties; however, silicone rubber is markedly porous to chemical warfare molecules.

Parylene is a known chemical material that can be applied as a thin film coating to other materials to reduce tackiness and surface stickiness, which features are particularly common with elastomers. The parylene/silicone bond is accomplished without adding stiffness to the base material and thus has previously been used on items that are frequently handled, e.g., rubber keypads for calculators, cell phones and the like. It can prevent build-up and penetration of oils and dirt and helps to maintain the original surface appearance. Moreover, the addition of a parylene film permits stretching of the base elastomer without breaking of the bond between the two materials.

Parylene coatings have low permeability rates for specific common gases. Heretofore, however, it was unknown to test or use parylene to block smoke, as well as NBC/CBR gases, e.g., Saran gas. It was also known that parylene can be bonded to elastomers, including silicone rubber. Parylene, however, does not exhibit the elongation properties of silicone rubber. So, it would be anticipated that the coating would crack or tear when the silicone rubber neck dam is stretched during the donning of the protective hood. The surface areas of the coated neck dam that are highly stretched during donning do not always exhibit good barrier properties, but the stretched surface areas are relatively small compared to the overall surface area of the neck dam. The surprising end result of using a parylene coated silicone rubber hood collar is a permeation rate three to four times less than uncoated silicone rubber for two specific test gases (chosen for testing because of their aggressive permeation characteristics).

A wide variety of protective head-worn, hood devices are known. For example: U.S. Pat. No. 6,586,048, issued to Welch, Jr. et al., discloses a method for depositing a barrier coating on a polymeric substrate such as, for example, silicone rubber and a composition forming the barrier coating. This publication also discloses the protective effects of parylene with respect to chemical, nuclear and biological warfare, as well as the protective effect a coating of parylene on silicone rubber can have with respect to extending the functionality and life of the silicone rubber polymer. Welch, Jr. et al., however, do not disclose or suggest the use of a parylene coating with respect to a protective hood to be worn over the user's head. U.S. Publication No. 2002/0182392, by Welch, Jr. et al., contains essentially the same disclosure as the issued patent referenced above.

U.S. Pat. No. 5,654,054, issued to Tropsha et al., discloses a plastic container coated with a barrier coating. At least one layer of the barrier coating disclosed is parylene. The patent discloses the increased resistance of parylene-coated materials to gas permeability, but does not disclose the use of parylene with respect to a protective hood.

U.S. Pat. No. 6,270,872, issued to Cline et al., discloses parylene-coated devices with adhesive. The patent discloses application of a parylene coating to rubber, but does not disclose the particular application of parylene of the present invention, namely its use in conjunction with a protective hood with an elastomeric neck seal, such as, for example, the victim rescue unit known as the VRU+, currently marketed by Essex PB&R Corp. Further, although the Cline et al. patent discloses the use of the parylene-coated material to form a seal, against skin, for example, it does not disclose the chemical or biological protective effects of parylene-coated materials important to the present invention.

U.S. Pat. No. 6,129,360, issued to Walker et al., discloses an anti-bleed coating for silicone automobile gaskets. The patent discloses applying parylene coating to a gasket at a thickness of at least 0.0001 inches, and preferably 0.0002 inches or more. The disclosure indicates that parylene provides enhanced resistance to slipping and bleeding, but does not suggest the protective effect of parylene with respect to permeability to gases or chemical and biological agents. The Walker et al. patent also does not disclose the use of parylene in conjunction with a protective hood.

U.S. Publication No. 2002/0168530, by Tingey et al., discloses a lubricious coating for a medical device. The coating is applied to a flexible portion of the device to minimize friction. The publication discloses the use of parylene as the coating. The publication does not, however, disclose the use of parylene in conjunction with a protective hood, nor does it disclose the biological or chemical-protective properties of parylene coating.

U.S. Publication No. 2003/0066972, by Leblans et al., discloses a phosphor panel with good humidity resistance. The humidity resistance is achieved by coating the phosphor panel with parylene. The publication discloses the fact that parylene can be resistant to moisture and certain types of radiation. The publication does not disclose using parylene in conjunction with a protective hood, nor does it disclose that parylene would be beneficial in protection from chemical, biological or nuclear warfare.

U.S. Pat. No. 5,424,097, issued to Olson et al., discloses a continuous vapor deposition apparatus. The apparatus is used to coat an object with a coating material such as parylene. The patent does not disclose the use of parylene coating in conjunction with a protective hood, nor does it disclose the chemical and biological-protective properties of parylene coating important to the present invention.

U.S. Pat. No. 5,075,174, issued to Pyle, discloses parylene-coated elastomers. Specifically, the patent discloses an elastomeric gasket made of a silicone elastomer and coated with a parylene layer. The effect of the parylene is to reduce the surface energy of the elastomeric material. The patent does not disclose the use of parylene coating with respect to a protective hood, nor does it disclose biological or chemical-protective properties of parylene coating.

U.S. Pat. No. 5,139,813, issued to Yira et al., discloses a method for inducing fluorescence in parylene films by use of an active plasma. The fluorescence is then used to perform quality control on parylene coatings. The patent does not disclose the use of parylene in conjunction with a protective hood, nor does it disclose biological or chemical-protective properties of parylene coating.

U.S. Publication No. 2003/0111074, by Alon et al., discloses a respiratory hood for protection against gases or other chemical or biological warfare agents. The publication does not disclose or suggest the use of parylene in conjunction with the hood.

U.S. Pat. No. 6,233,748, issued to Gieger et al., discloses an environmental protection system for rendering biological and/or chemical agents harmless. The patent does not disclose the use of parylene in conjunction with the personal protective equipment disclosed.

U.S. Pat. No. 6,158,429, issued to Gardner et al., discloses a hood respirator for protection against biological hazards. The patent does not disclose the use of parylene in conjunction with the hood.

U.S. Pat. No. 5,957,131, issued to Hutchinson et al., discloses a biological warfare mask. The patent does not disclose the use of parylene in conjunction with the mask.

U.S. Pat. No. 5,875,775, issued to Nur et al., discloses a protective breathing mask. The patent does not disclose the use of parylene in conjunction with the mask.

U.S. Pat. No. 5,660,173, issued to Newton, discloses a frustum-layered canister for use in conjunction with a gas mask. The patent does not disclose the use of parylene in conjunction with either the canister or the gas mask.

U.S. Pat. No. 4,883,052, issued to Weiss et al., discloses a protective breathing mask. The patent does not disclose the use of parylene in conjunction with the mask.

U.S. Pat. No. 4,643,182, issued to Klein, discloses a disposable protective mask. The patent does not disclose the use of parylene in conjunction with the mask.

Accordingly, there has been a long-felt need, which has become more urgent in recent years, for a protective hood to be placed over the user's head, and which can reliably secure the wearer from harmful nuclear, chemical or biological fumes or other agents. It is among the goals and objects of the present invention to provide such a protective hood, which reliably protects the wearer and is also facile to use, even by a non-expert, can be placed on an unconscious person by a rescuer, and is sufficiently inexpensive to manufacture that it can be made available quite economically, particularly when manufactured in large numbers, for example, for military personnel or for all employees of a particular manufacturing plant or some facility which could be at risk of, e.g., a terrorist attack or leakage of toxic fumes or smoke. It is further among the objects of the present invention, having the features indicated, that the new hood be light weight for comfort and ease of use and be capable of being stored in a sufficiently small space that it permits on-site storage in large numbers, or carrying on one's person. None of the references discussed above, either alone or in any combination teach or suggest the present protective hood structure with the neck seal coated with parylene.

Accordingly, in keeping with the above objects and advantages, the new protective hood is, briefly, a neck seal for use in an emergency breathing apparatus. The neck seal or "dam" has an interior and an exterior and is formed of an annular sheet of elastomeric material having a substantially central aperture for donning over a person's head. The substantially central aperture is sized appropriately for snug fitting around the person's neck so as to be sufficiently tight to prevent passage between the person's neck and the neck seal of fluid materials without choking the person. The neck seal is coated at least in part with parylene, to thereby prevent passage through the elastomeric material of NBC/CBR materials.

These and other objects and advantages will be in part apparent and in part pointed out herein below.

DETAILED DESCRIPTION

Figure 1:
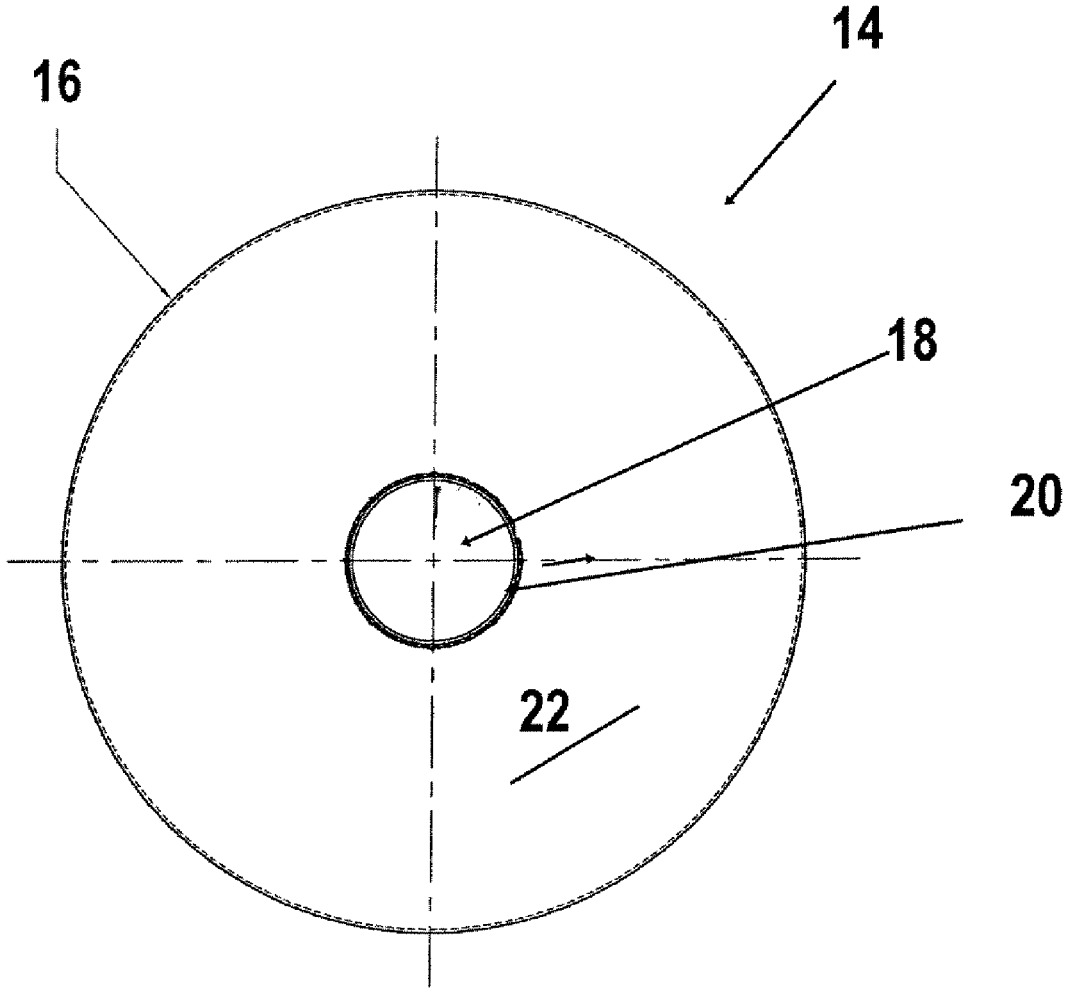
FIG. 1 is a bottom plan view of the new neck seal from the side disposed outwardly on a new protective hood and toward the wearer's shoulders during use.
Figure 2:
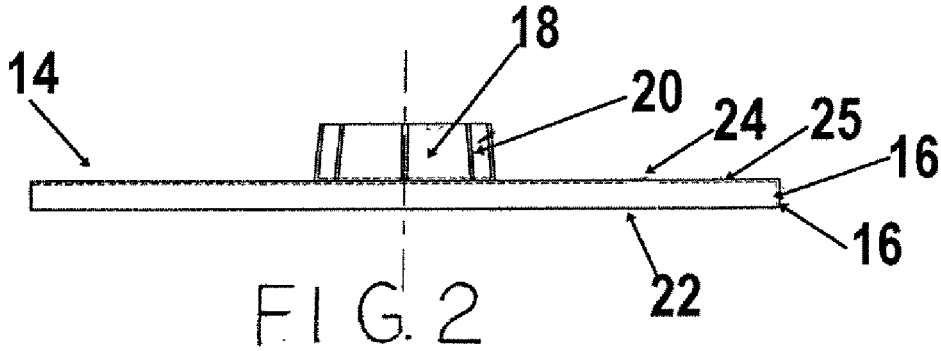
FIG. 2 is a sectional view through the center of the new neck seal for the protective hood.

With reference to the several drawings, a protective breathing apparatus, generally designated 10, includes a hood portion 12 for covering the user's head. A neck seal, generally designated 14, is shown in FIGS. 1 and 2.

Neck seal 14 is formed of elastomeric sheet-like material, preferably entirely, and at least in part, silicone, and has a substantially circular perimeter 16. A substantially centrally located aperture 18 is provided in and defined by neck seal 14 and is large enough that it can be readily manually stretched for purposes of donning apparatus 10 over a wearer's head and thereafter accommodating the wearer's neck, without choking the wearer. A contiguous rim or collar 20 extends on one side of neck seal 14 so as to provide a fluid-tight interface between the breathing apparatus and the wearer's skin.

Figure 3:
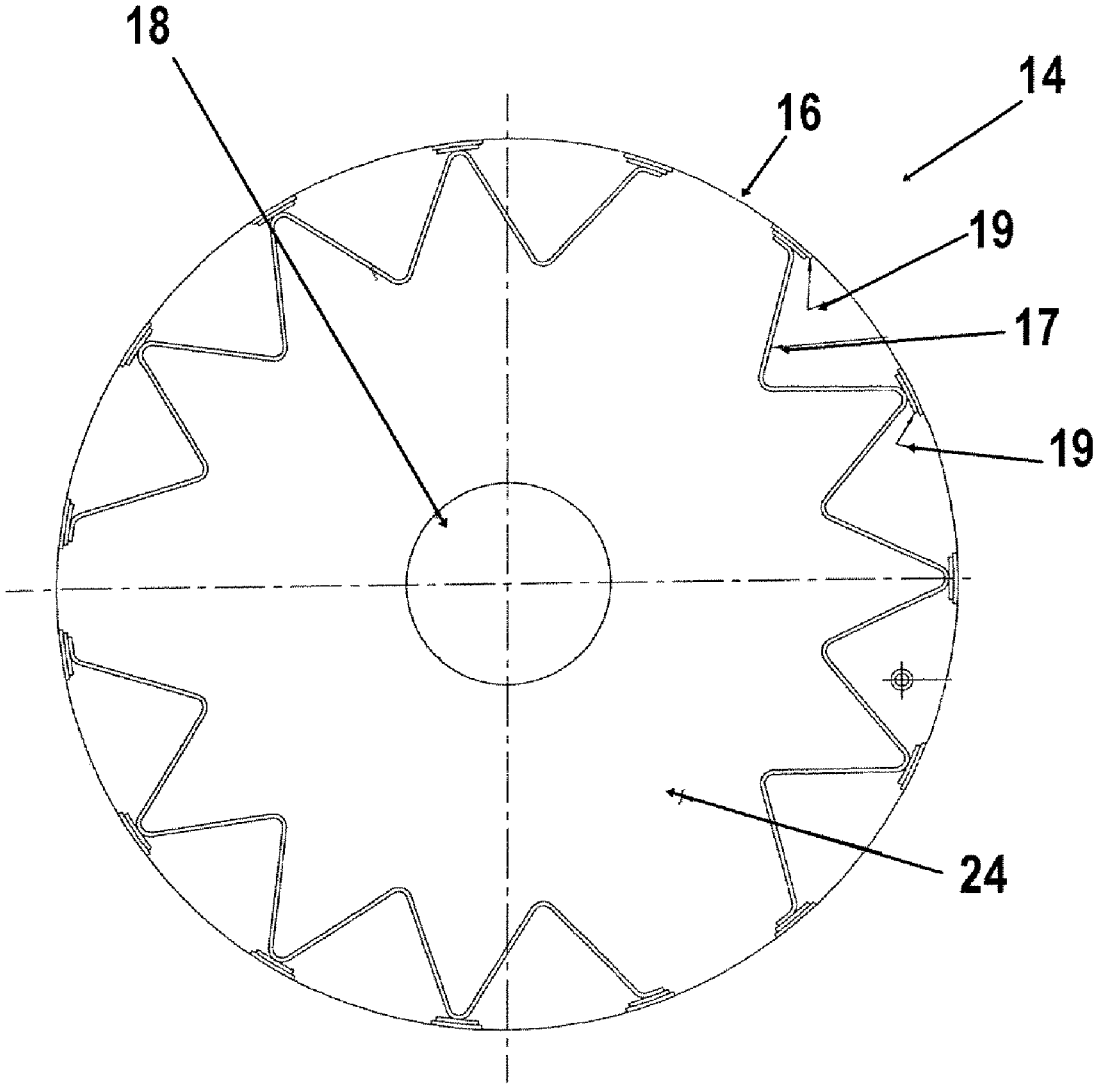
FIG. 3 is a top plan view of the new neck seal from the side disposed internally of the new protective hood to which the neck seal is attached.

Neck seal 14 is extremely strong, yet pliable enough to be manually stretched so that aperture 18 will fit over a wearer's head. As shown in FIGS. 1 3 neck seal 14 is laid out so that an outer surface 22 and an inner surface 24 of the neck seal are seen in a substantially flat position. The new and important feature of the presently described protective hood and neck seal thereof is that the neck seal is completely coated, at least on one of surfaces 22, 24, and preferably on both of them, with a thin layer 25 of parylene, as indicated schematically in FIG. 2. An example of a suitable type of parylene is referred to in the industry as DPX-C, although other types can also be used effectively. In the preferred embodiment the coating of parylene covers the entire surface of each side of neck seal 14 to a thickness in the range of 1.0 to 2.0 microns, and most preferably 1.5 microns. It is to be understood that a thickness greater than 2.0 microns of parylene would function to protect the wearer of hood 10, but is not preferred from a manufacturing standpoint.

Optionally, a narrow band around the perimeter 16 of neck seal 14 can be uncoated, to facilitate bonding of such perimeter to the interior of hood 12 at or near the lower extent thereof.

Hood portion 12 of protective breathing apparatus 10 includes an upper transparent portion 13 for two-way viewing, which is made from multiple layers of polytetrafluoroethylene (PFA)/polyimide film. The polyimide film offers high heat resistance. A lower metallic film portion 15 extends between and connects the upper transparent area to the perimeter of parylene coated neck seal 14 and is lined with a passive, known, "scrubber" material 17. Scrubber 17 is loosely connected to the interior of metallic portion 15 by sections of conventional hook and loop fasteners, as indicated at 19, or by other suitable connector(s). The hood is not so dense as to prohibit oral communication for a reasonable distance, for example to about four yards, and the material of the hood is resistance to radiant heat, transient hot air, dripping thermoplastics and transient flame. The materials of the hood 12 preferably can withstand heat up to 1800 degrees F. for up to about five seconds and can withstand dripping plastics and tars up to about 390 degrees F. An example of a suitable protective breathing apparatus which is suitable for use with the improvement of the described parylene coating over a silicone neck seal is currently being marketed under the name VRU+by Essex PB&R Corp.

Figure 4:
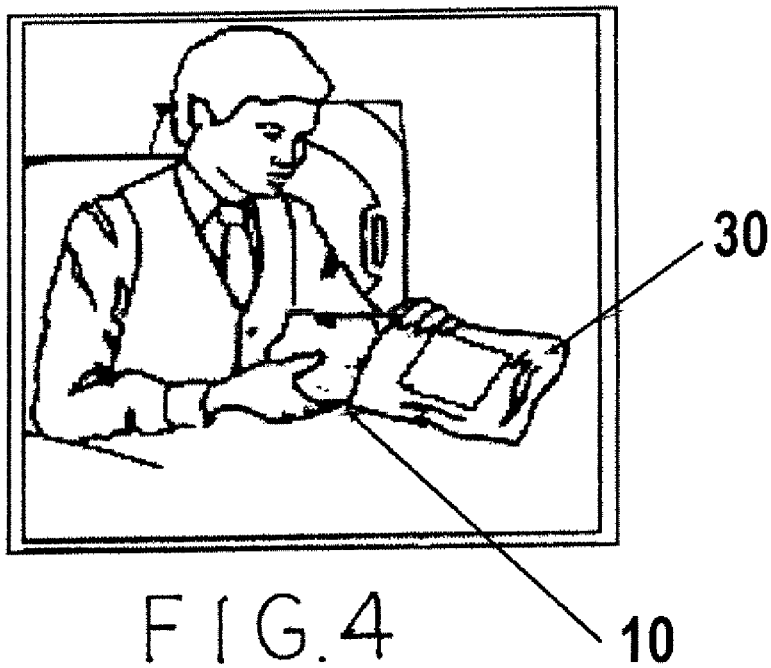
FIG. 4 is a schematic view of a person removing a protective hood from a storage bag.
Figure 5:
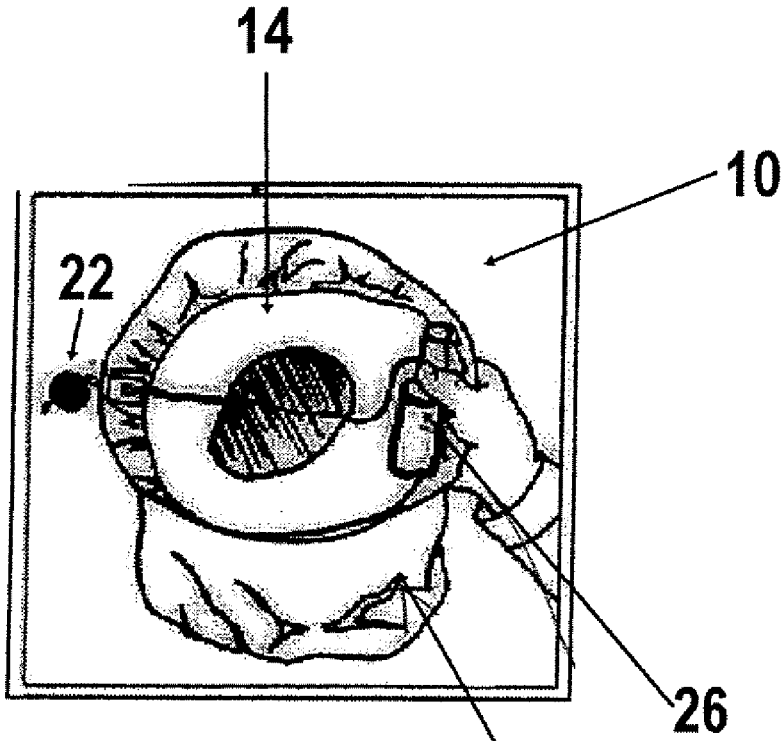
FIG. 5 is a schematic view of the underside of the new protective hood having a neck seal in accordance with FIG. 1.

In practice, the new protective breathing apparatus 10 is stored long term in a stowage pouch which is very compact and suitable for storage of large numbers of such devices 10 on an airplane or elsewhere. To use in an emergency situation the stowage pouch (not shown) is opened and a vacuum sealed bag, such as indicated at 30, containing protective breathing apparatus 10 is removed from the stowage pouch. The vacuum bag is opened by pulling a clearly indicated tape or other opening device. Then new emergency passenger oxygen system, breathing apparatus 10, is removed from the vacuum bag, as depicted schematically in FIG. 4 and unfolded to a position substantially as shown in FIG. 5. An oxygen cylinder 26 is connected at the bottom of hood portion 12, and is activated by a pull cord 28 or other simple, known mechanism.

Figure 6:
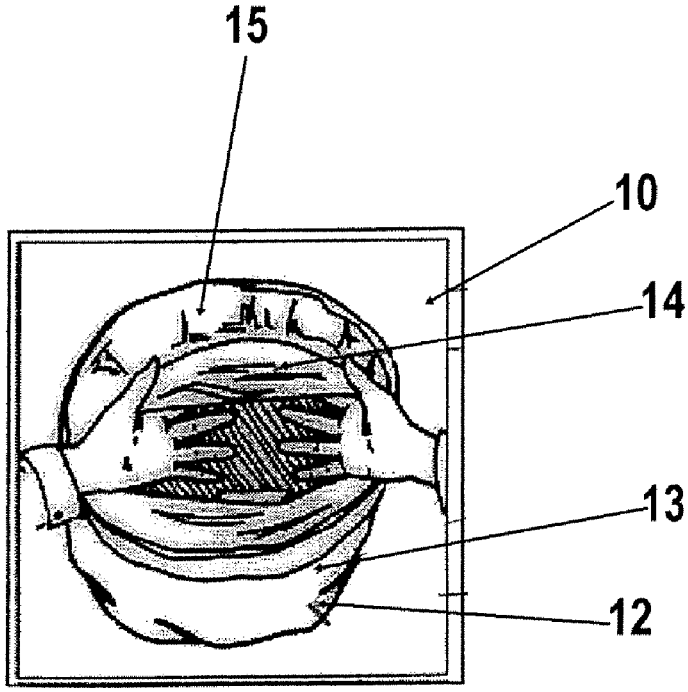
FIG. 6 is a schematic view of the underside of the hood of FIG. 4 showing the user's hands stretching the neck seal opening in preparation for donning the hood.
Figure 7:
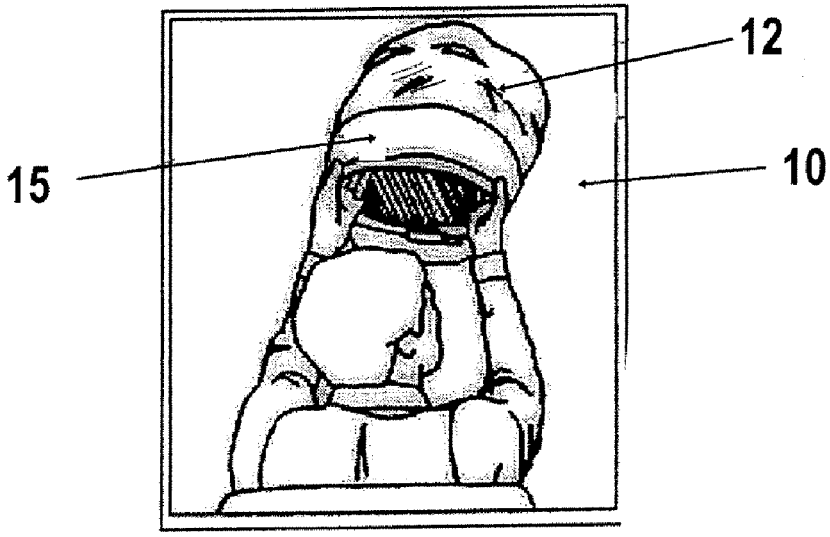
FIG. 7 is a schematic view of a person about to place the new hood with the neck seal stretched open over the person's head for use.

As indicated in FIG. 6, the user simply pulls neck seal 14 open at aperture 18 and then dons the breathing apparatus 10 in the manner shown in FIG. 7. Hood portion 12 is pulled down over the user's head and neck with the neck seal stretched open. The user can then breath normally for a limited amount of time, depending upon the user's activity level. The hood portion will fully inflate within several minutes and after full inflation there is sufficient oxygen from canister 26 to permit the user to breathe normally. The breathing apparatus 10 is removed when the hood portion 12 collapses to the point that it touches the wearer's face or when instructed by aircrew or other "in charge" personnel. Examples of reasonably expected use time for the apparatus 10, with a bottled source of 100% aviators-grade compressed oxygen, with over-pressure protection, are up to 60 minutes when sitting, waiting for rescue; waiting seventeen minutes to be rescued, then rapid evacuation up to twenty-one minutes; moderate walking (three mph) up to eighteen minutes; evacuation of a multi story building, up to twenty minutes; rapidly walking, on a flat surface, out of a building, up to eight minutes; and rapidly walking up fifteen flights of stairs, up to three minutes. Obviously the entire unit is light enough that it can be easily carried on the wearer's person during movement required for evacuation from a site of fire or toxic fumes or chemicals.

In view of the foregoing, it will be seen that the several objects of the invention are achieved and other advantages are attained. Although the foregoing includes a description of the best mode contemplated for carrying out the invention, various modifications are conceivable.

As various modifications could be made in the constructions and methods herein described and illustrated without departing from the scope of the invention, it is intended that all matter contained in the foregoing description or shown in the accompanying drawings shall be interpreted as illustrative rather than limiting.

The invention claimed is:

1. A protective hood having a neck seal for use in an emergency breathing apparatus having an interior and an exterior; the neck seal comprising:

a protective hood having a base opening for fitting over a user's head said opening having circumferentially connected thereabout, an annular sheet of elastomeric material having a substantially central aperture for donning over a person's head, the substantially central aperture being sized appropriately for snug fitting around the person's neck so as to be sufficiently tight to prevent passage between the person's neck and the neck seal of fluid materials without choking the person;

wherein the the annular sheet of elastomeric material is coated at least in part with parylene, to thereby prevent passage through the elastomeric material of NBC/CBR materials; and wherein the central aperture of the annular sheet has a contiguous collar extending from the central aperture's inner edge for forming a fluid-tight interface surface with the wearer's neck.

2. The neck seal of claim 1, wherein the elastomeric material of the neck seal is coated with parylene having a thickness of about approximately 1.0 micron to about approximately 2.0 microns.

3. The neck seal of claim 2, wherein the neck seal has a first side and a second side and is substantially entirely coated with parylene on at least one of the first side and the second side.

4. The neck seal of claim 3, wherein the first side is disposed facing the interior of the emergency breathing apparatus and is substantially entirely coated with parylene.

5. The neck seal of claim 3, wherein the second side is disposed facing the exterior of the emergency breathing apparatus and is substantially entirely coated with parylene.

6. The neck seal of claim 3, wherein both the first side and the second side of the neck seal are substantially entirely coated with parylene.

7. The neck seal of claim 1, wherein the parylene coating on the annular sheet is coated on a substantially silicone elastomeric annular sheet.

8. The neck seal of claim 7, wherein the parylene coating on the elastomeric annular sheet is approximately 1.5 microns thick.

9. An improved protective breathing apparatus having a hood for fitting over the user's head and a neck seal connected at the base of the hood, the neck seal being formed of elastomeric material and having an opening for passage therethrough of the user's head upon stretching of the neck seal, wherein the improvement comprises a coating of parylene on an annular sheet of the elastomeric material forming the neck seal to thereby deter passage through the neck seal of NBC/CBR agents and wherein the opening has a contiguous collar extending from an inner edge of the opening for forming a fluid-tight interface with the user's neck.

10. The protective breathing apparatus of claim 9, wherein the elastomeric material forming the neck seal has a parylene coating applied thereon having a thickness from about approximately 1.0 micron to about approximately 2.0 microns.

11. The protective breathing apparatus of claim 9, wherein the breathing apparatus has a face shield including a transparent area for viewing therethrough.

12. The protective breathing apparatus of claim 9, wherein the parylene coating is applied on a substantially silicone neck seal.

13. The protective breathing apparatus of claim 12, wherein the parylene coating on the elastomeric neck seal is approximately 1.5 microns thick.

14. The protective breathing apparatus of claim 9, and further comprising a scrubber device attached to an internal surface of the hood portion of the breathing apparatus substantially adjacent to the neck seal.

15. An improved emergency personal oxygen system comprising:

a fire-resistant fabric pouch for containing a vacuum sealable pouch and a protective breathing apparatus;

a vacuum sealable pouch for containing a protective breathing apparatus; and a protective breathing apparatus including a hood portion and a neck seal having two opposed surfaces and having a central aperture connected to the hood portion and an transportable oxygen source in fluid contact with the interior of the breathing apparatus; wherein the improvement comprises a coating of parylene substantially entirely over at least one of the two opposed surfaces of the neck seal to thereby deter passage through the neck seal of NBC/CBR agents, and where the aperture of the neck seal has extending from the inner edge a contiguous collar.

* * * * *